US011193484B2

(12) United States Patent
Squarcini et al.

(10) Patent No.: US 11,193,484 B2
(45) Date of Patent: Dec. 7, 2021

(54) AUTOMOTIVE LIQUID PENDULUM VANE PUMP

(71) Applicant: PIERBURG PUMP TECHNOLOGY GMBH, Neuss (DE)

(72) Inventors: Raffaele Squarcini, Leghorn (IT); Antonio Dipace, Duesseldorf (DE); Emanuele Pellegrini, Pisa (IT)

(73) Assignee: PIERBURG PUMP TECHNOLOGY GMBH, Neuss (DE)

( * ) Notice: Subject to any disclaimer, the term of this patent is extended or adjusted under 35 U.S.C. 154(b) by 169 days.

(21) Appl. No.: 16/487,094

(22) PCT Filed: Feb. 24, 2017

(86) PCT No.: PCT/EP2017/054286
§ 371 (c)(1),
(2) Date: Aug. 20, 2019

(87) PCT Pub. No.: WO2018/153468
PCT Pub. Date: Aug. 30, 2018

(65) Prior Publication Data
US 2021/0115919 A1 Apr. 22, 2021

(51) Int. Cl.
*F03C 2/00* (2006.01)
*F03C 4/00* (2006.01)
(Continued)

(52) U.S. Cl.
CPC ..... *F04C 2/332* (2013.01); *F01C 21/08* (2013.01); *F01C 21/0809* (2013.01);
(Continued)

(58) Field of Classification Search
CPC ..... F04C 2/332; F04C 2/336; F04C 2/348; F04C 14/22; F04C 14/223; F04C 14/226; F01C 21/08; F01C 21/0809
See application file for complete search history.

(56) References Cited

U.S. PATENT DOCUMENTS 2,778,317 A * 1/1957 Cockburn ..... F01C 21/0809 418/78
2006/0191360 A1 8/2006 Beez
(Continued)

FOREIGN PATENT DOCUMENTS

CN 2345738 Y 10/1999
CN 105864033 A 8/2016
(Continued)

*Primary Examiner* — Theresa Trieu
(74) *Attorney, Agent, or Firm* — Norman B. Thot

(57) ABSTRACT

An automotive liquid pendulum vane pump includes a pump housing, a rotor ring with circular undercut recesses, a rotor hub with vane slots, and pendulum vanes which connect the rotor ring and the rotor hub. Each vane slot has a substantially plane contact wall slot with a tangential contact nose in an opening region and a diving recess. Each pendulum vane has a circular pendulum head which defines a pendulum hinge which corresponds to a circular undercut recess, a circular pendulum foot which is radially shiftable and pivotable in a vane slot, a vane leg which connects the circular pendulum head and the circular pendulum foot, and a contact path with a contact path surface which contacts the tangential contact nose in a rotational contact sector. A radial inner end of the contact path surface defines an inner tangential projection which temporarily dives into the diving recess.

8 Claims, 3 Drawing Sheets

(51) Int. Cl.

| | |
|---|---|
| ***F04C 18/00*** | (2006.01) |
| ***F04C 2/332*** | (2006.01) |
| ***F01C 21/08*** | (2006.01) |
| ***F04C 2/336*** | (2006.01) |
| ***F04C 2/344*** | (2006.01) |
| ***F04C 14/22*** | (2006.01) |

(52) U.S. Cl.
CPC ..... *F04C 2/336* (2013.01); *F04C 2/3448* (2013.01); *F04C 14/22* (2013.01); *F04C 14/223* (2013.01)

(56) References Cited

U.S. PATENT DOCUMENTS

| | | | | |
|---|---|---|---|---|
| 2011/0300015 | A1 | 12/2011 | Kirchner et al. | |
| 2013/0251580 | A1 | 9/2013 | Maeder et al. | |
| 2013/0343940 | A1* | 12/2013 | Ammon ..... | F04C 14/226 418/27 |
| 2016/0230758 | A1 | 8/2016 | Haugaard | |

FOREIGN PATENT DOCUMENTS

| | | | | |
|---|---|---|---|---|
| DE | 19532703 | C1 * | 11/1996 | ..... F04C 14/226 |
| DE | 10 2010 023 068 | A1 | 12/2011 | |
| DE | 10 2012 219 847 | A1 | 4/2014 | |
| DE | 10 2015 006 403 | A1 | 11/2015 | |
| EP | 2 642 073 | A2 | 9/2013 | |
| JP | 2003-307185 | A | 10/2003 | |
| JP | 2007-510082 | A | 4/2007 | |

* cited by examiner

AUTOMOTIVE LIQUID PENDULUM VANE PUMP

CROSS REFERENCE TO PRIOR APPLICATIONS

This application is a U.S. National Phase application under 35 U.S.C. § 371 of International Application No. PCT/EP2017/054286, filed on Feb. 24, 2017. The International Application was published in English on Aug. 30, 2018 as WO 2018/153468 A1 under PCT Article 21 (2).

FIELD

The present invention relates to an automotive liquid pendulum vane pump for providing a pressurized liquid, for example, for the lubrication of an automotive traction engine with a pressurized lubrication liquid. The present invention can, for example, relate to a mechanical pendulum pump which is not driven electrically, but which is mechanically driven by the automotive traction engine, and which is, for example, provided as a variable pendulum pump of which the volumetric performance is variable and independent of the pump's rotational speed.

BACKGROUND

Compared to a conventional vane pump with rotor vanes which simply slide along a circumferential wall, a pendulum pump has much less wear at the vanes and has a higher hydraulic quality because the pump chambers separated by the pendulum vanes are fluidically very tight. The mechanical concept of a pendulum pump is relatively complex because a rotatable rotor hub as well as a rotatable rotor ring is provided, and the pendulum vanes radially connecting the rotor ring and the rotor hub provide a pendulum oscillation at their rotational path.

If the avoidance of a complex transmission gear between the rotor hub and the eccentric rotor ring is sought, the rotor hub drives the rotor ring or the rotor ring drives the rotor hub via the pendulum vanes. DE 10 2012 219 847 A1 and EP 2642 073 A2 both describe typical automotive lubricant pendulum pumps. DE 10 2012 219 847 A1 describes a variable pendulum pump with a shiftable control ring for shifting the rotor ring between a maximum eccentricity and a minimum eccentricity position. The rotational force is transferred from the rotor hub or from the rotor ring to the pendulum vane. Pump performance is maximized in the maximum eccentricity position of the control ring supporting the rotor ring, so that a maximum rotational force is transferred between the rotor hub and the rotor ring, and in particular between the driven rotor part and the pendulum vanes. The contact sector in which the rotational force is transferred from the rotor hub or the rotor ring to the pendulum vanes can, however, be so small that temporarily no single or only one single pendulum vane is driven with the rotational force. This leads to transfer force peaks which cause relatively high mechanical wear.

SUMMARY

An aspect of the present invention is to provide an automotive liquid pendulum pump with an increased contact sector.

In an embodiment, the present invention provides an automotive liquid pendulum vane pump which includes a pump housing, a rotor ring configured to be rotatable, a rotor hub configured to be rotatable and non-shiftable, and a plurality of pendulum vanes which are configured to mechanically connect the rotor ring and the rotor hub. The rotor ring comprises a plurality of circular undercut recesses. The rotor hub comprises a plurality of vane slots. Each vane slot of the plurality of vane slots is substantially radial and comprises an opening region, and a contact wall slot which comprises a tangential contact nose in the opening region of the vane slot and a diving recess. The contact wall slot is configured to be substantially plane. Each pendulum vane of the plurality of pendulum vanes comprises a circular pendulum head which defines a pendulum hinge which corresponds to a respective one of the plurality of circular undercut recesses of the rotor ring, a circular pendulum foot which is configured to be radially shiftable and pivotable in one of the plurality of vane slots, a vane leg which is configured to connect the circular pendulum head and the circular pendulum foot, an inner tangential projection, and a contact path comprising a contact path surface which contacts the tangential contact nose in a rotational contact sector. A radial inner end of the contact path surface defines the inner tangential projection. The inner tangential pendulum projection is configured to temporarily dive into the diving recess during an operation of the automotive liquid pendulum vane pump.

BRIEF DESCRIPTION OF THE DRAWINGS

The present invention is described in greater detail below on the basis of embodiments and of the drawings in which.

DETAILED DESCRIPTION

Figure 1:
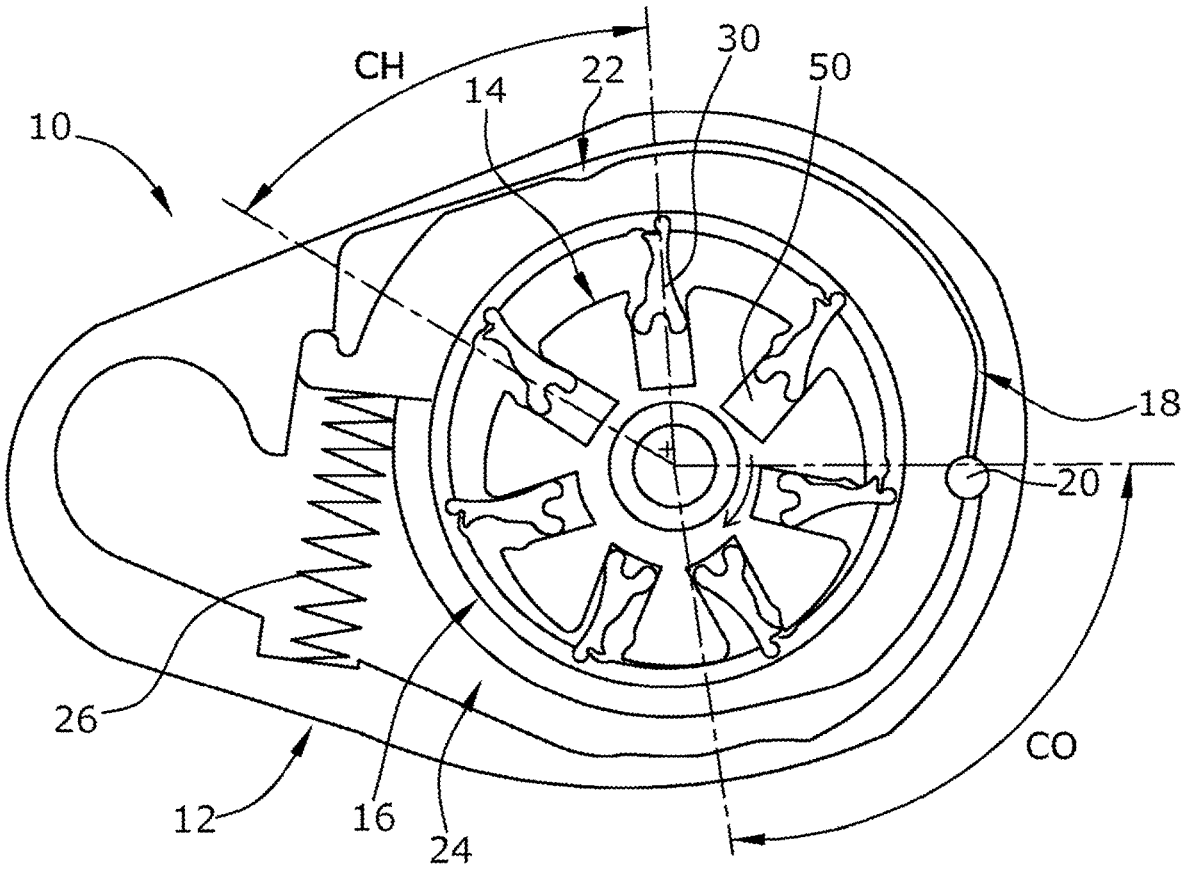
FIG. 1 shows a top view of an opened automotive liquid pendulum pump according to the present invention.
Figure 2:
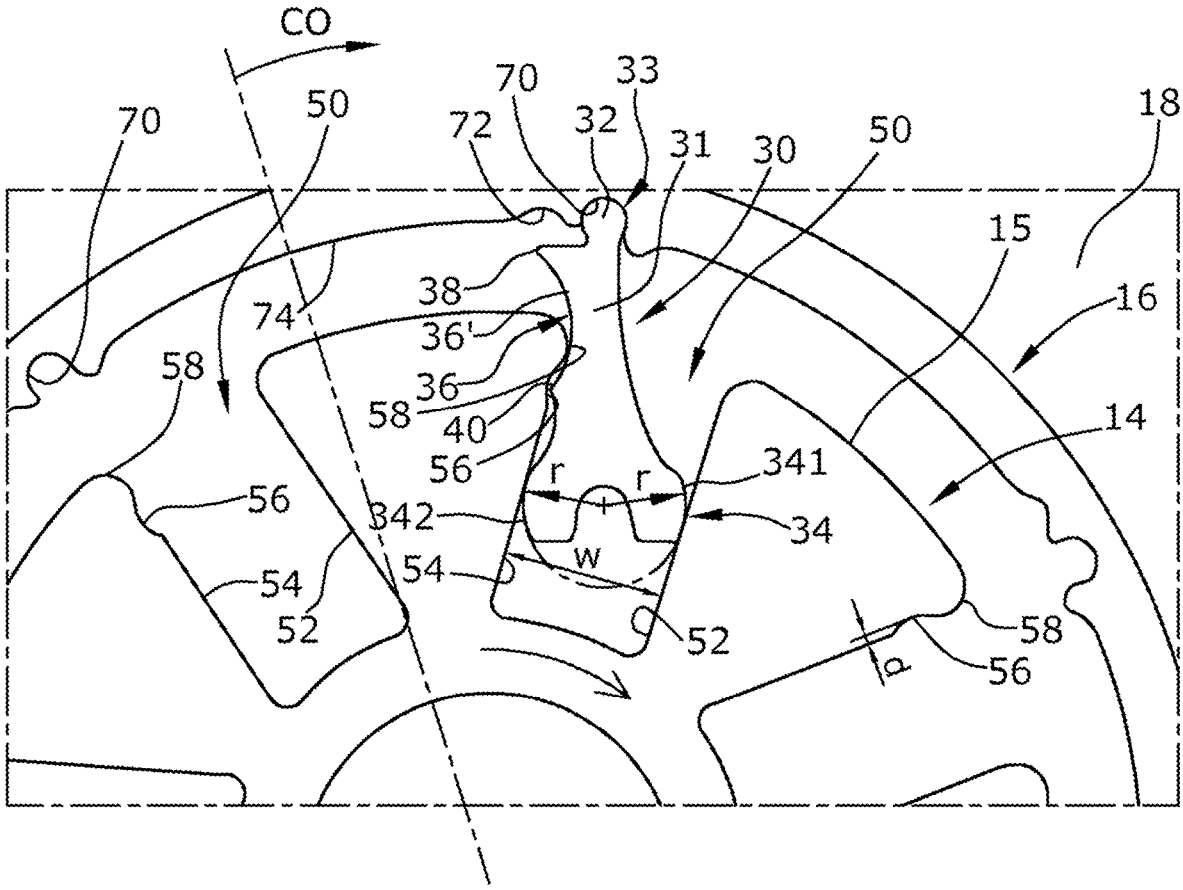
FIG. 2 shows an enlarged view of FIG. 1, showing a pendulum vane in the contact sector CO.
Figure 3:
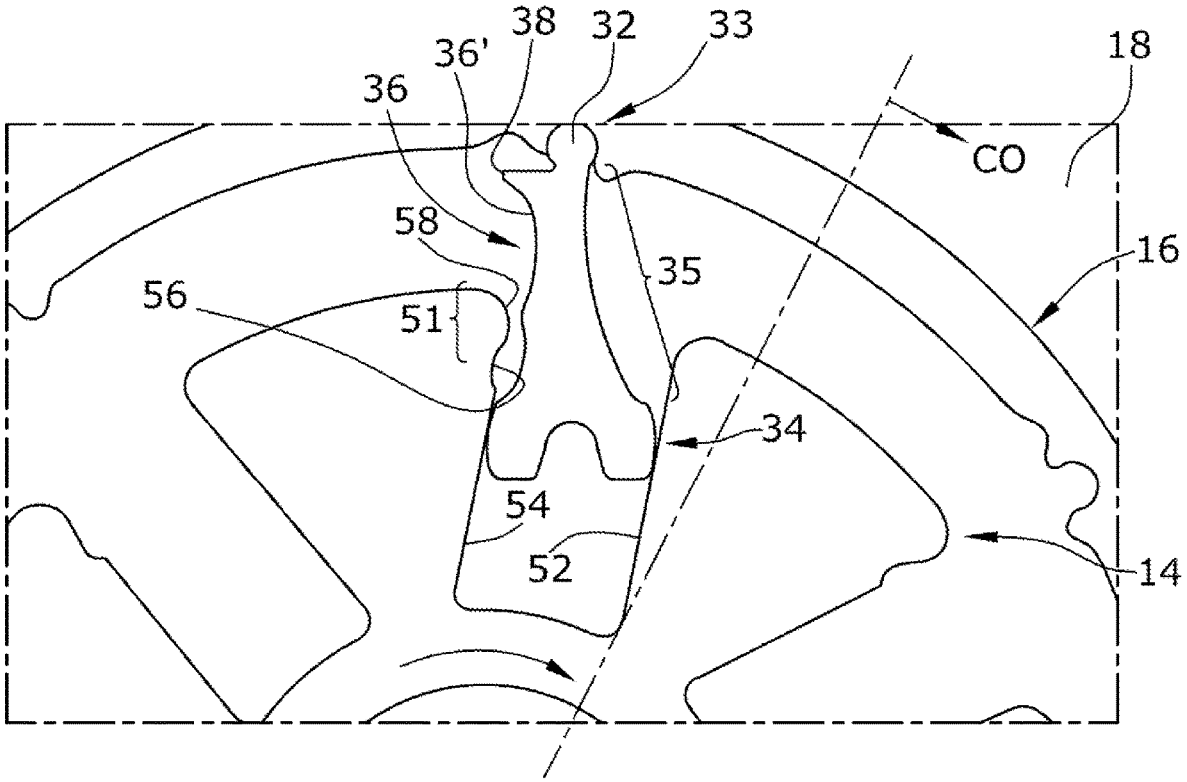
FIG. 3 shows an enlarged view of FIG. 1, showing a pendulum vane right before rotating into the contact sector CO.

The automotive liquid pendulum pump according to the present invention is provided with a static pump housing, with a rotatable rotor ring, a rotatable and non-shiftable rotor hub comprising numerous substantially radial vane slots, and with numerous pendulum vanes mechanically connecting the rotor ring and the rotor hub. The rotatable rotor ring can be provided to be shiftable or non-shiftable. If the rotatable rotor ring is provided to be non-shiftable, the rotatable rotor ring is always at a position of maximum eccentricity. If the rotatable rotor ring is provided to be shiftable, the rotatable rotor ring can be shifted and positioned between a maximum eccentricity position and a minimum eccentricity position. The pendulum vanes separate the rotating pump chambers from each other and transmit a rotational force between the rotor hub and the rotor ring. The vane slots at the rotor hub are not necessarily provided with an exactly radial orientation, however, the slot orientation necessarily has a large radial component.

The pendulum pump is gear-free so that no rotational force is transferred between the rotor hub and the rotor ring by an external gear. The rotational force is only transferred by the pendulum vanes from the driven rotor hub to the rotor ring.

Every pendulum vane comprises a circular pendulum head defining a pendulum hinge together with a corresponding circular undercut recess at the rotor ring. The pendulum vane is hinged non-shiftably but pivotably at the rotor ring. The pendulum hinge is provided at the radially outer end of the pendulum vane.

A circular pendulum foot is provided at the radial inner end of the pendulum vane. The pendulum foot is arranged to be radially shiftable and also to be pivotable in the corresponding linear vane slot. The vane slot is substantially a linear vane slot with parallel and plane slot walls. The circular pendulum foot is not a closed circle, but is provided with circular and cylindrical portions which provide that the pendulum foot is always guided and supported in the vane slot in a substantially fluid-tight manner. The circular portions always define a sliding contact-line with the corresponding vane slot wall. The other portions of the pendulum foot are not necessarily circular.

The pendulum head and the pendulum foot are connected by a vane leg. The pendulum vane can, for example, be provided as one single piece.

The vane slot is provided with a contact slot wall which is substantially plane. A tangential contact nose is provided in the opening region of the vane slot for transferring the rotational force between the pendulum vane and the rotor hub. If the rotor hub drives the rotor ring, the contact nose is provided at the lagging side of the opening edge of the vane slot. If the rotor ring drives the rotor hub, the contact nose is provided at the advancing side of the opening edge of the vane slot.

The contact nose is provided as an axial profile extending over the axial length of the vane slot. The axial direction of the pendulum pump is the direction of the rotational axis of the rotor hub.

The pendulum vane is provided with a contact path defined by a contact path surface being in contact with the contact nose within the pump contact sector. At maximum eccentricity, the contact path surface is in a force-transferring contact with the contact nose only in the pump contact sector, whereas the contact path surface is not in contact with the contact nose outside the pump contact sector. The larger the pump contact sector, the more average numbers of pairs of the contact path surface and the contact nose transfer the rotational force between the rotor hub and the pendulum vanes.

The radial inner end of the contact path surface defines a tangential projection which tangentially projects from the body of the pendulum vane leg. The radial extent of the contact path is relatively long and can, for example, be somehow bent so that the contact path, for example, defines a concave surface. The longer the radial extent of the contact path, the more the radially inner tangential projection protrudes from the vane leg in a tangential/circumferential direction.

The cooperating contact slot wall opposite the contact path is completely plane in the region where the pendulum foot moves and can contact, and is provided with a diving recess at the radially outer end section of the vane slot. The diving recess is provided radially inwardly of and, for example, adjacent to the contact nose.

The tangential pendulum projection temporarily dives into the diving recess so that a mechanical contact between the radially inner tangential projection of the pendulum vane and the contact slot wall is always avoided, independent of the rotational position and the eccentricity. The diving recess provides for a substantial increase of the radial extent of the contact path so that the contact sector is also substantially increased. The average mechanical force transfer load of every pendulum vane is consequently accordingly decreased so that the pump's reliability and lifetime is increased, and/or a higher total rotational force can be transferred between the rotor hub and the pendulum vanes.

The contact sector is the rotational sector where the contact path surface is in a force-transmitting contact with the contact nose.

In an embodiment of the present invention, the rotor hub or the rotor ring can, for example, be mechanically driven. The pendulum pump is not driven by a separate electric motor, but is mechanically driven by an engine which can be the traction engine of the automotive device. Since the pendulum pump is mechanically driven by the traction engine, the rotational speed of the pendulum pump varies within a wide range of, for example, 500 to 5,000 rpm. The rotational speed of the pendulum pump therefore does not correspond with the required hydraulic performance of the pendulum pump.

The pendulum pump is therefore provided with a shiftable and non-rotatable control ring which is shiftable with respect to the pump housing between a minimum eccentricity position and a maximum eccentricity position. The eccentricity is the distance of the rotation axis of the rotor hub and of the rotor ring. The rotor ring is rotatably and co-shiftably supported by the control ring. The shifting path can be linear or circular. The volumetric capacity of the pump can be adapted by shifting the control ring into a suitable position, thereby defining a suitable volumetric performance. The geometric restrictions in a variable pendulum pump are severe, so that it is difficult to realize a large contact sector. The relatively long contact path, as seen in a radial direction, provides for a relatively smooth transfer of the rotational force between the rotor hub and the pendulum vanes.

In an embodiment of the present invention, the inner tangential projection of the pendulum vane can, for example, dive into the corresponding diving recess at least at the maximum eccentricity position of the shiftable control ring; the maximum eccentricity constitution is the most critical situation with respect to the high rotational force to be transferred. The tangential projection can, for example, dive into the recess at any eccentricity position.

In an embodiment of the present invention, the radial extent of the contact path can, for example, be so large that the contact sector is at least 1.1 times the chamber sector which is defined by the angle between two neighbored pendulum vanes or between neighbored vane slots. At least one pendulum vane therefore always transfers the rotational force between the rotor hub and the rotor ring at every eccentricity, and in particular at maximum eccentricity. The rotational force is therefore continuously transferred so that high transfer force peaks at the vanes are avoided.

In an embodiment of the present invention, the radially outer end of the contact path surface can, for example, define an outer tangential projection. The rotor ring is provided with radial recesses adjacent to the corresponding circular undercut recesses so that the outer tangential vane projection temporarily dives into the corresponding radial recess. The outer tangential projection allows a maximal extension of the radial extent of the contact path so that the contact sector can be maximized.

In an embodiment of the present invention, the tangential depth of the tangential diving recess at the contact slot wall can, for example, be at least 0.1 mm, under reference to the general plane of the contact slot wall.

In an embodiment of the present invention, the rotor hub can, for example, drive the rotor ring. The rotor hub is mechanically or electrically driven by an external device.

An embodiment of the present invention is described in greater detail below under reference to the enclosed drawings.

FIG. 1 shows an open (i.e., without a cover lid) automotive liquid pendulum pump 10 which is provided to be mechanically driven. The pendulum pump 10 is a so-called variable pendulum pump of which the volumetric performance can be controlled independent of the rotational speed.

The pendulum pump 10 can be mechanically connected to and driven by a traction engine, for example, by an internal combustion engine. The pendulum pump 10 provides a pressurized lubricant liquid, for example, to lubricate the traction engine and/or to provide an actuation force to a hydraulic device.

The pendulum pump 10 is provided with a metal pump housing 12 housing, a shiftable and non-rotatable control ring 18, a rotatable and shiftable rotor ring 16, and a rotatable and non-shiftable rotor hub 14. The control ring 18 is provided to pivot around a pivot element 20 so that the shifting path of the control ring 18 is not exactly linear, but is circular. The shifting position of the control ring 18 is defined by two counteracting hydraulic control chambers 22, 24 and a preload spring 26.

The control ring 18 supports the rotor ring 16 so that the control ring 18 defines the shifting position of the rotor ring 16 and thereby defines the eccentricity of the rotor ring 16 with respect to the rotor hub 14. The rotor ring 16 can thereby be shifted and positioned between a maximum eccentricity position, as shown in FIG. 1, and a minimum eccentricity position in which the eccentricity can be close to zero or even zero so that only a minimum volumetric performance or no volumetric performance at all is realized.

The pendulum pump 10 is provided with seven pendulum vanes 30 mechanically connecting the rotor ring 16 and the rotor hub 14. The rotor hub 14 is mechanically driven by an external power device, for example, by an internal combustion engine, and directly drives the pendulum vanes 30 and indirectly drives the rotor ring 16. The rotor hub 14 has a generally cylindrical surface 15 and comprises seven radial vane slots 50 for guiding the pendulum vanes 30. The vane slots 50 define slot openings at the cylindrical surface 15.

The pendulum vanes 30 have two functions, namely, to separate the rotating pump chambers from each other and to transfer the rotational force from the rotor hub 14 to the rotor ring 16 to co-rotate the rotor ring 16 with the rotor hub 14.

Each pendulum vane 30 comprises, at the radial outer end, a circular pendulum head 32 which is pivotably supported in a corresponding circular undercut recess 70 at the rotor ring 16. The circular pendulum head 32 and the circular undercut recess 70 together define a pendulum hinge 33 so that the pendulum vane 30 can oscillate with respect to the rotor ring 16.

The pendulum vanes 30 comprise a circular pendulum foot 34 at the radially inner end thereof. The circular pendulum foot 34 is not completely circular, but is provided with two circular sections 341, 342 which are provided with a constant foot radius r with reference to the pendulum foot center. The circular pendulum foot 34 is provided to be pivotable as well as to be radially shiftable in the corresponding vane slot 50 in an approximately fluid-tight manner.

The vane slot 50 is defined by four radial slot walls which are provided parallel with the radial slot center axis and are defined by the rotating rotor hub 14 and the static housing side walls. The vane slots 50 have a tangential slot width w between the lagging vane slot wall 54 and the parallel advancing vane slot wall 52 defined by the rotor hub 14. The slot width w is approximately two times the foot radius r of the circular pendulum foot 34: $w=2\times r$.

The lagging vane slot wall 54 defines a contact slot wall 54 and is provided with a tangential contact nose 58 in the opening region 51 of the vane slot 50. The contact nose 58 has a constant cross-section over its entire axial extent and has a radius of at least a few millimeters. The contact nose 58 is not a sharp edge.

The pendulum vane 30 is provided with a contact path 36 defined by a concave contact path surface 36' which is provided at the lagging side of the pendulum vane 30 and is in contact with the corresponding contact nose 58 when the corresponding pendulum vane 30 and vane slot 50 is rotatory within a contact sector CO. The contact sector CO is the rotational sector where the contact path surface 36' is in a mechanical and force-transmitting contact with the corresponding contact nose 58 to transfer the rotational force from the rotor hub 14 to the pendulum vane 30 and via the pendulum vane 30 to the rotor ring 16.

In the shown embodiment, the contact sector CO is 1.5 times larger than the chamber angle CH defined by the angle enclosed by two neighbored vane slots 50 or two neighbored pendulum vanes 30. This means that, at a maximum eccentricity position as shown in FIG. 1, the average number of pendulum vanes 30 transferring the rotational force from the rotor hub 14 to the rotor ring 16 is about 1.5 at the maximum eccentricity position. The contact sector is smaller than in the maximum eccentricity position at other eccentricity positions.

The radial inner end of the contact path surface 36' defines an inner tangential pendulum projection 40 tangentially protruding from the vane leg 35 connecting the circular pendulum head 32 and the circular pendulum foot 34. The pendulum vane 30 is defined by one single vane body 31.

The generally plane contact slot wall 54 is provided with a concave diving recess 56 radially inwardly adjacent to the contact nose 58. The diving recess 56 has a tangential depth d of more than 0.5 mm with respect to the general plane of the contact slot wall 54. In the maximum eccentricity position as shown in FIG. 1 and during the contact phase within the contact sector CO, the inner tangential pendulum projection 40 dives into the diving recess 56 without contacting the surface of the diving recess 56.

The radial outer end of the contact path surface 36' defines an outer tangential pendulum projection 38 tangentially projecting from the vane leg 35. The outer tangential pendulum projection 38 is provided radially inwardly adjacent to the circular pendulum head 32. The rotor ring 16 is provided with radial recesses 72 tangentially adjacent to the circular undercut recesses 70. The radial recesses 72 and the circular undercut recesses 70 are provided at the inner circumferential surface 74 of the rotor ring 16. The outer tangential projection 38 temporarily dives into the corresponding radial recess 72 during the rotor rotation, but not, for example, in the contact sector CO.

The present invention is not limited to embodiments described herein; reference should be had to the appended claims.

What is claimed is:

1. An automotive liquid pendulum vane pump comprising:

a pump housing;

a rotor ring configured to be rotatable, the rotor ring comprising a plurality of circular undercut recesses;

a rotor hub configured to be rotatable and non-shiftable, the rotor hub comprising a plurality of vane slots, each vane slot of the plurality of vane slots being substantially radial and comprising:

an opening region, and a contact wall slot which comprises a tangential contact nose in the opening region of the vane slot and a diving recess, the contact wall slot being configured to be substantially plane; and a plurality of pendulum vanes configured to mechanically connect the rotor ring and the rotor hub;

each pendulum vane of the plurality of pendulum vanes comprising:

a circular pendulum head which defines a pendulum hinge which corresponds to a respective one of the plurality of circular undercut recesses of the rotor ring, a circular pendulum foot which is configured to be radially shiftable and pivotable in one of the plurality of vane slots, a vane leg which is configured to connect the circular pendulum head and the circular pendulum foot, an inner tangential pendulum projection, and a contact path comprising a contact path surface which contacts the tangential contact nose in a rotational contact sector, a radial inner end of the contact path surface defining the inner tangential pendulum projection, wherein, the inner tangential pendulum projection is configured to temporarily dive into the diving recess during an operation of the automotive liquid pendulum vane pump, and a mechanical contact between the inner tangential pendulum projection of the pendulum vane and the contact wall slot is always avoided, independent of a rotational position.

2. The automotive liquid pendulum vane pump as recited in claim 1, further comprising:

a control ring which is configured to be shiftable and non-rotatable with respect to the pump housing between a minimum eccentricity position and a maximum eccentricity position, wherein the rotor hub or the rotor ring is configured to be mechanically driven by an external engine, and the rotor ring is rotatably and co-shiftably supported by the control ring.

3. The automotive liquid pendulum vane pump as recited in claim 2, wherein the inner tangential pendulum projection dives into the diving recess at the maximum eccentricity position of the control ring.

4. The automotive liquid pendulum vane pump as recited in claim 1, wherein the inner tangential pendulum projection dives into the diving recess within the rotational contact sector.

5. The automotive liquid pendulum vane pump as recited in claim 1, wherein, an angle between two neighboring pendulum vanes of the plurality of pendulum vanes define a chamber sector, and the rotational contact sector is at least 1.0 times larger than the chamber sector.

6. The automotive liquid pendulum vane pump as recited in claim 1, wherein, the contact path surface of the contact path of each of the plurality of pendulum vanes comprises a radial outer end which defines an outer tangential projection, and the rotor ring further comprises a plurality of radial recesses which are arranged adjacent to a respective one of the plurality of circular undercut recesses so that each outer tangential projection temporarily dives into a corresponding one of the plurality of radial recesses.

7. The automotive liquid pendulum vane pump as recited in claim 1, wherein each diving recess comprises a tangential depth which is at least 0.1 mm with respect to the contact wall slot.

8. The automotive liquid pendulum vane pump as recited in claim 1, wherein the rotor hub is further configured to drive the rotor ring.

* * * * *